US008297926B2

(12) United States Patent
Groβ

(10) Patent No.: US 8,297,926 B2
(45) Date of Patent: Oct. 30, 2012

(54) TURBINE BLADE

(75) Inventor: Heinz-Jürgen Groβ, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 616 days.

(21) Appl. No.: 12/513,742

(22) PCT Filed: Sep. 20, 2007

(86) PCT No.: PCT/EP2007/059935
§ 371 (c)(1),
(2), (4) Date: May 6, 2009

(87) PCT Pub. No.: WO2008/055737
PCT Pub. Date: May 15, 2008

(65) Prior Publication Data

US 2010/0143153 A1 Jun. 10, 2010

(30) Foreign Application Priority Data

Nov. 8, 2006 (EP) ..... 06023274

(51) Int. Cl.
*F01D 5/18* (2006.01)

(52) U.S. Cl. ..... 416/96 R; 415/115

(58) Field of Classification Search ..... 415/115, 415/116; 416/96 R, 97 R, 95
See application file for complete search history.

(56) References Cited

U.S. PATENT DOCUMENTS

| | | | | |
|---|---|---|---|---|
| 5,468,125 | A | 11/1995 | Okpara et al. | |
| 5,857,837 | A | 1/1999 | Zelesky et al. | |
| 6,890,153 | B2 * | 5/2005 | Demers et al. | 416/96 R |

FOREIGN PATENT DOCUMENTS

| | | | |
|---|---|---|---|
| EP | 0416542 | A1 | 3/1991 |
| EP | 0945595 | A2 | 9/1999 |
| EP | 1043479 | A2 | 10/2000 |
| EP | 1077311 | A1 | 2/2001 |
| EP | 1473439 | A2 | 11/2004 |
| EP | 1508746 | A1 | 2/2005 |
| EP | 1510653 | A2 | 3/2005 |
| GB | 1350424 | A | 4/1974 |
| GB | 2257479 | A | 1/1993 |
| JP | 61063401 | U | 4/1986 |
| JP | 8296403 | A | 11/1996 |
| WO | WO 2004035992 | A1 | 4/2004 |

OTHER PUBLICATIONS

Communication from Japanese Patent Office, Nov. 28, 2011, pp. 1-6.

* cited by examiner

*Primary Examiner* — Dwayne J White

(57) ABSTRACT

A turbine blade comprising at least one cooling element, a cooling duct for conducting a cooling medium, and a leading edge is provided. The cooling element is located within the flow of the cooling medium and is designed in a cog-shaped manner. The cooling duct is formed within the turbine blade for conducting a cooling air flow and extends along the flow attacking edge in at least some sections. The cooling elements are successively arranged in a stationary manner inside the cooling duct in the longitudinal direction. Each individual cooling element has a cooling capacity that is adapted to a predefined cooling requirement for the leading edge in the vicinity of the cooling element.

3 Claims, 1 Drawing Sheet

TURBINE BLADE

CROSS REFERENCE TO RELATED APPLICATIONS

This application is the US National Stage of International Application No. PCT/EP2007/059935, filed Sep. 20, 2007 and claims the benefit thereof. The International Application claims the benefits of European Patent Office application No. 06023274.1 EP filed Nov. 8, 2006, both of the applications are incorporated by Reference herein in their entirety.

FIELD OF INVENTION

The invention refers to a turbine blade according to the claims.

BACKGROUND OF INVENTION

Turbine blades, especially turbine blades for gas turbines, are exposed to high temperatures during operation, which quickly exceed the limit of material stress. This especially applies to the regions in the vicinity of the flow inlet edge on which the hot process gas flow first of all impinges upon the blade profile of the turbine blade. In order to be able to use turbine blades even at high temperatures it has already been known for a long time to suitably cool turbine blades so that they have a higher resistance to temperature. With turbine blades which have a higher resistance to temperature, higher energy efficiencies in particular can be achieved.

Known types of cooling are inter alia convection cooling, impingement cooling and film cooling. In the case of convection cooling, cooling air is guided through passages inside the blade and the convective effect is utilized in order to dissipate the heat. In the case of impingement cooling, a cooling air flow from inside impinges upon the inner surface of the blade. In this way, a very good cooling effect is made possible at the point of impingement, but which is limited only to the narrow region of the impingement point and the immediate vicinity. This type of cooling is therefore mostly used for cooling the flow inlet edge, which is also referred to as the leading edge, of a turbine blade. In the case of film cooling, cooling air is guided from inside the turbine blade outwards via holes in the turbine blade. This cooling air flows around the turbine blade and forms an insulating layer between the hot process gas and the blade surface. The described types of cooling, depending upon the application case, are suitably combined in order to achieve blade cooling which is as effective as possible.

Such a turbine blade with impingement-cooled inflow edge, which has ribs and turbulators on the inner surface which faces the impingement cooling passage, is known from EP 1 473 439 A2. In this case, impingement cooling holes through which cooling air can be directed onto the ribs which are arranged on the inner surface, are provided in a bridge which connects the suction-side wall to the pressure-side wall.

In addition to the types of cooling which are described above, the use of cooling means, such as turbulators, which in most cases are provided in the form of ribs, is very common. These ribs are arranged inside the cooling passages which are provided for the convection flow and extend inside the turbine blade. The installation of ribs in the cooling passages causes the flow of cooling air in the boundary layers to be separated and swirled. As a result of the disturbance of the flow which is forced in this way, heat transfer can be increased in the case of an existing temperature difference between cooling passage wall and cooling air. As a result of the ribbing, the flow constantly causes new "re-attachment fields" to be formed, in which a significant increase of the local heat transfer coefficient can be achieved. The service life of known ribs is limited as a result of the high operating temperatures, which is especially a consequence of the geometry which forms the basis of known ribs. The thermal stresses which are associated with the known rib-geometries result in internal cracks which can limit the service life of the rib and therefore ultimately also limit the period of operation of the turbine blade.

For cooling the flow inlet edge, i.e. leading edge, of turbine blades, which during operation is thermally very severely stressed in most cases, cooling passages, which extend parallel to and close to the flow inlet edge, are often formed in turbine blades, to which cooling passages cooling air is fed by means of further cooling passages which are formed in the blades. The convective cooling of the flow inlet edge which is realized in this way is supplemented in the case of film-cooled blades mostly by means of impingement cooling of the inner wall of the cooling passage which extends close to the flow inlet edge. In applications in which no film cooling of the turbine blades is undertaken, the convective cooling is intensified by means of turbulators which are arranged on the inner wall of the cooling passage.

When considered overall, both in the case of film-cooled blades and in the case of blades which are not film-cooled, there is currently still a clear need for improvement with regard to the cooling, especially with regard to the cooling of the flow inlet edge. In particular, the current cooling solutions make no allowance either for an inhomogeneous temperature distribution which develops during the use of turbine blades.

SUMMARY OF INVENTION

The invention is based on the object of disclosing a turbine blade which, both in the case of existing film-cooling and in the case of non-existent film-cooling, can be cooled more effectively compared with known solutions, and which has a longer period of operation.

This object is achieved according to the invention with a turbine blade according to the features of the claims.

The turbine blade has a leading edge which extends on one side of the turbine blade, wherein the cooling passage is delimited in relation to the leading edge by means of a wall section, and has two or more cone-shaped cooling elements with different lengths which extends from this wall section into the cooling passage and the length of which is different for adapting to the locally predetermined cooling requirement.

The leading edge, which as a rule is thermally severely stressed, can therefore be cooled very effectively. By means of the cooling elements according to the invention, which extend from the wall section into the cooling passage, and which especially bring about an intense swirling of the cooling medium, the heat transfer can be noticeably increased in the case of an existing temperature difference between the wall section and the cooling medium, accompanied by a significant increase of the local heat transfer coefficient. When considered overall, in this way the heat in the vicinity of the leading edge can be dissipated very effectively, accompanied by a very effective cooling of the leading edge.

According to the invention, the cooling elements, which are first exposed to inflow of the cooling medium in an impingement cooling-like manner, are designed in the form of pins or ribs. Cooling elements, which are designed in the form of cones, on the one hand bring about an enlargement of the coolable wall surface, and on the other hand, after impingement cooling has been carried out, cause a very intense swirling of the cooling medium, for example in the form of cooling air, wherein as a result of the severe disturbance of the flow which is forced in this way the heat transfer is increased in the case of an existing temperature difference between one wall of the cooling passage and the cooling medium, accompanied by a significant increase of the local heat transfer coefficient.

In addition, with the design of the cooling elements in the form of cones which is provided according to the invention, the thermal stresses which develop in the cooling elements during operation of the turbine blade are minimized so that internal cracks cannot occur. In particular, the thermal stresses are noticeably lower in this case than the thermal stresses which develop in known turbulators. According to the invention, the whole stress situation is therefore improved, and a noticeable increase of the service life of the cooling elements compared with known solutions can be achieved, wherein a long period of operation or service life of the turbine blade is also associated with the long service life of the cooling elements.

The turbine blade according to the invention can be exposed to higher gas temperatures compared with known solutions, even if no film cooling is provided. If film cooling is provided, still higher gas temperatures are possible. In turn, the possibility of being able to design the turbine blade according to the invention with thinner external walls results from this.

According to the invention, the cooling capability of each individual cone-shaped cooling element is adapted over a suitably formed length to the predetermined local cooling requirement in the vicinity of the cooling element. Cooling elements, in the vicinity of which a high cooling requirement exists, have a greater length according to the invention than cooling elements in the vicinity of which the cooling requirement is less pronounced. By increasing the length of an individual cooling element, for one thing the "swirling region", as well as the surface which is to be cooled, is increased, accompanied by a noticeable increase of the local heat transfer coefficient.

In a practical development of the invention, the wall section has a wall surface which faces the cooling passage, wherein the at least one cooling element, or the two or more cooling elements, extends, or extend, into the cooling passage orthogonally to the wall surface or orthogonally to the curved wall surface. The extent in a direction orthogonal to the wall surface of the cooling passage, which is provided according to the invention, brings about a very effective swirling of the cooling medium which is accompanied by a very effective cooling, especially of the leading edge, since according to the invention an exposure of the cooling elements to inflow with the cooling medium which is oriented essentially at right-angles to the longitudinal extent of the cooling elements can take place.

In a further advantageous development of the invention, the cooling passage is preferably delimited by means of a wall section which has a curved wall surface which faces the cooling passage, wherein two or more cooling elements are provided, wherein the cooling elements have a longitudinal extent which extends into the cooling passage, and wherein the two or more cooling elements are oriented with their longitudinal extent towards the center of the curvature of the wall surface.

By means of cooling elements, which with their longitudinal extent are oriented towards the center of the curvature of the wall surface, a very effective swirling of the cooling medium which flows onto the cooling elements can be achieved. In particular, by means of this development according to the invention the convection cooling which is realized by means of the cooling elements can be very effectively combined with an impingement cooling in such a way that the cooling medium flows onto the cooling elements in a way in which it impinges upon the cooling elements so that a very high cooling effect can be achieved at the respective impingement point, which in conjunction with the convection cooling which is made available results in a very effective cooling of the turbine blade according to the invention.

In a further practical development of the invention, the at least one cooling element, or the two or more cooling elements, is, or are, formed in one piece with the wall section.

Turbine blades during operation as a rule have a very inhomogeneous temperature distribution which is associated with large thermal stresses which act upon the turbine blades and in particular have a disadvantageous effect upon the service life of the turbine blades. So, for example for turbine blades which are used in turbines which are axially exposed to throughflow, an inhomogeneous temperature distribution, which develops along the radial direction, is created for the leading edge. As a result of the use according to the invention of cooling elements inside the cooling passage, which preferably extends close to the leading edge, the cooling capability of which cooling elements is adapted over their length to a predetermined cooling requirement, for example for the leading edge in the vicinity of the cooling element, the temperature distribution, for example on the leading edge, can be "homogenized" since according to the invention a correspondingly intense cooling is carried out and vice versa at comparatively hot places by means of suitably formed cooling elements. The turbine blade according to the invention can therefore be cooled in a way which counteracts an inhomogeneous temperature distribution, which is especially advantageous with regard to an effective cooling of the leading edge.

A rear wall, which partially delimits the cooling passage, lies opposite the wall section, and in which one or more impingement cooling holes are provided, is preferably provided as means for impingement cooling of the wall section. These impingement cooling holes are preferably positioned and oriented in the rear wall in such a way that the cooling air jets which flow through them are directed onto the cooling elements, as a result of which an especially efficient cooling of the leading edge can be achieved. In particular, on account of the comparatively large longitudinal extent of the cooling elements into the cooling passage the distance between cooling element tips on one side and the mouth of the impingement cooling hole on the other side can be kept comparatively small. This also applies in the case of a comparatively large outflow cross section of the cooling passage. A disturbance of the impingement cooling jets as a result of cooling air which flows transversely to the jets, i.e. along the cooling passage, can therefore be safely avoided.

The invention refers overall to a turbine blade with a leading edge, with a cooling passage which is formed in the turbine blade for the conducting of cooling air and which extends at least in sections along the leading edge, and with a number of cooling elements which, in the longitudinal direction of the cooling passage, are arranged one after the other in a fixed manner in this cooling passage, wherein each individual cooling element has a cooling capability which is adapted to a predetermined cooling requirement for the leading edge in the vicinity of the cooling element, and wherein the cooling passage preferably extends parallel to the leading edge continuously through the turbine blade.

BRIEF DESCRIPTION OF THE DRAWINGS

An exemplary embodiment of a turbine blade according to the invention is subsequently explained in more detail with reference to the attached drawings. In the drawing.

DETAILED DESCRIPTION OF INVENTION

Figure 1:
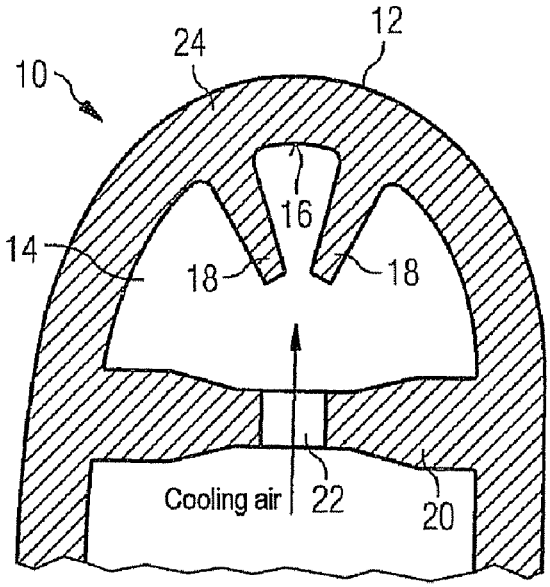
FIG. 1 shows a rough cross-sectional view of a turbine blade according to the invention with a number of cone-shaped cooling elements which are arranged in a cooling passage.

FIG. 1 shows a rough sectional view of a front section of a blade airfoil of a turbine blade 10 according to the invention, with a flat plane of section at right angles to its leading edge 12. The leading edge 12 can also be referred to as the flow inlet edge. Inside the turbine blade 10, a cooling passage 14, which extends parallel to the leading edge 12 (that is to say a radially extending passage 14 in the case of turbines which are axially exposed to throughflow), is formed close to the leading edge 12 and is delimited in relation to the leading edge 12 by means of a wall section 24. Cone-shaped cooling elements 18 extend into the cooling passage 14 from a curved wall surface 16 of the cooling passage 14, wherein the cooling elements 18 are oriented with their longitudinal extent towards the center of the curvature of the wall surface 16.

In a rear wall 20 of the cooling passage 14 holes 22 are formed in order to feed cooling air with impingement cooling effect to the cooling passage 14 from further cooling passages (not shown) which are formed in the rear region of the turbine blade 10.

Figure 2:
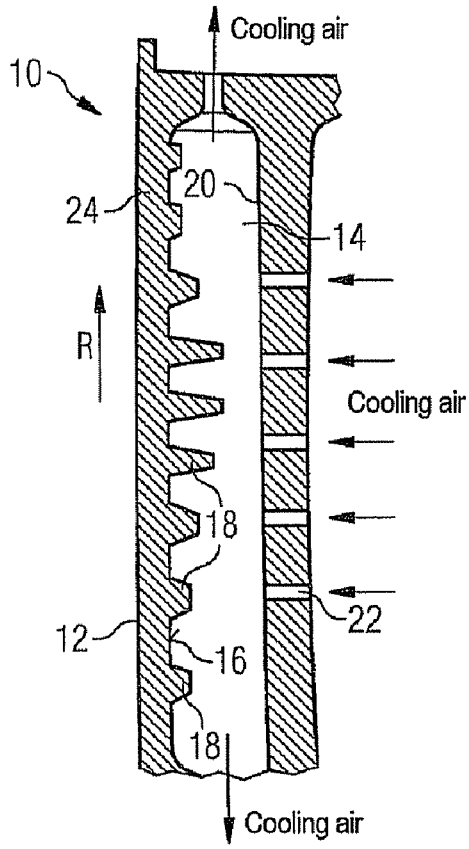
FIG. 2 shows a longitudinal section through the turbine blade along a leading edge.

FIG. 2 shows a further sectional view of the front section of the turbine blade 10 according to the invention, with a flat plane of section parallel to the leading edge 12. The cooling elements 18 which are formed on the curved wall surface 16 of the cooling passage 14 extend orthogonally from the curved wall surface 16 into the cooling passage 14. As is apparent from FIG. 2, the length of the cooling elements 18 varies in the radial direction R. According to the invention, this serves for counteracting the inhomogeneous temperature distribution which develops along the leading edge 12 when the turbine blade 10 is in use. Thus, this turbine blade will have a higher operating temperature especially towards the center of the leading edge 12 of the turbine blade 10 than in the peripheral regions of the leading edge 12. For this reason, the truncated cone-shaped cooling elements 18 have a greater length in the center region than in the peripheral regions since, as explained above, by increasing the length of the cooling elements 18 the local heat transfer coefficient and therefore the cooling capability of the cooling elements 18 can be increased.

The impingement cooling in the present case involves the impingement of cooling air, which issues from the holes 22, upon the curved wall surface 16, or upon the cooling elements 18, in order to locally enable a very good cooling effect there. Since according to the invention provision is made for the cooling elements 18 to be oriented with their longitudinal extent towards the center of the curvature of the wall surface 16, a very effective impingement cooling can be provided, with which in conjunction with the corresponding convection cooling a very effective cooling of the turbine blade 10 can be altogether provided. The cooling passage 14 is open on the two sides of the turbine blade 10 in order to allow the cooling air to flow in two directions from the cooling passage 14. As a result, a temperature harmonization of the turbine blade 10 is favored since where cooling air is required, cooling air is also made available, and the effect of the impingement cooling is not reduced as a result of a crossflow.

Instead of truncated cone-shaped forms, the cooling elements 18 can be also be designed in the form of ribs which extend along the cooling passage 14, that is to say in the flow direction of the cooling air. In this case, the area of the wall surface 16 is significantly increased in order to improve the cooling of the turbine blade 10 which is then preferably convectively cooled. In this case, it is conceivable that the height of the ribs, on account of the aforementioned locally different temperatures on the leading edge 12, can be correspondingly adapted to them.

The invention claimed is:

1. A turbine blade, comprising:

a blade airfoil, comprising:

a cooling passage, and a leading edge, extending along the blade airfoil; and a plurality of cone-shaped cooling elements extending from a wall section into the cooling passage, wherein a respective length of the cooling elements varies based on a radial height of the respective cooling element along the wall section;

wherein the wall section forms a border between the cooling passage and the leading edge and wherein the wall section comprises a wall surface facing the cooling passage, said wall surface having a curvature, wherein impingement cooling of the wall section is provided, and wherein the plurality of cooling elements have a longitudinal region which extends into the cooling passage, wherein the plurality of cooling elements are oriented each with the longitudinal region towards a center of the curvature of the wall surface such that the respective length of each cooling element is measured toward the center of the curvature of the wall surface and the respective length of each cooling element is adapted to a predetermined local cooling requirement.

2. The turbine blade of claim 1, wherein the respective length of the respective cooling element at a center radial region of the wall surface is greater than the respective length of the respective cooling element outside the center radial region of the wall surface, based on a higher operating temperature at a center of the leading edge corresponding to the center radial region of the wall surface.

3. The turbine blade of claim 2, further comprising a rear wall of the cooling passage that lies opposite to the wall section and includes a plurality of impingement cooling holes provided for impingement cooling of the wall section; wherein the cooling elements are oriented at the plurality of impingement cooling holes.

* * * * *